United States Patent [19]

Miura

[11] 4,335,435

[45] Jun. 15, 1982

[54] METHOD OF CHANGING ROLLING SCHEDULE DURING ROLLING IN TANDEM ROLLING MILL

[75] Inventor: Keiichi Miura, Kobe, Japan

[73] Assignee: Mitsubishi Denki Kabushiki Kaisha, Tokyo, Japan

[21] Appl. No.: 90,311

[22] Filed: Nov. 1, 1979

[30] Foreign Application Priority Data

Nov. 1, 1978 [JP] Japan ..... 53-135395

[51] Int. Cl.[3] ..... G06F 15/46; B21B 37/00

[52] U.S. Cl. ..... 364/469; 72/12; 72/240; 364/472

[58] Field of Search ..... 364/469, 472, 476; 72/7, 8, 9, 12, 16, 240

[56] References Cited

U.S. PATENT DOCUMENTS 3,722,244 3/1973 Fujii et al. ..... 72/16
3,852,983 12/1974 Cook ..... 72/12
4,087,859 5/1978 Anbe ..... 364/472

FOREIGN PATENT DOCUMENTS 48-17145 5/1973 Japan ..... 364/472
49-111858 10/1974 Japan ..... 364/472
50-13248 2/1975 Japan ..... 364/472

*Primary Examiner*—Joseph F. Ruggiero
*Attorney, Agent, or Firm*—Wenderoth, Lind & Ponack

[57] ABSTRACT

In a tandem rolling mill a control computer integrates the entry speed of a work strip having a gauge transition to determine the arrival of the transition at a first roll stand. At that time a screw-down on that stand is updated through a scheduling computer while roll speeds on all the stands remain unchanged. When the gauge transition arrives at each of the succeeding stands as determined by the control computer integrating a roll speed on the preceding stand, the scheduling computer updates a screw-down on the arrival stand and changes roll speeds so as to minimize the sum of the squares of changes in roll speed with the constant mass flow relationship fulfilled.

3 Claims, 3 Drawing Figures

| INIT GAUGE SCHED | 1st STD | 2nd STD | 3rd STD | --- | (n-1)-TH STD | n-TH STD |
|---|---|---|---|---|---|---|
| BEFE ARR AT 1st STD | $S_1$ | $S_2$ | $S_3$ | --- | $S_{n-1}$ | $S_n$ |
| TRANS AT 1st STD | $S'_1$ | = | = | --- | = | = |
| TRANS AT 2nd STD | = | $S'_2$ | = | --- | = | = |
| TRANS AT 3rd STD | = | = | $S'_3$ | --- | = | = |
| --- | = | = | = | / | = | = |
| TRANS AT (n-1)-TH STD | --- | --- | --- | --- | $S'_{n-1}$ | = |
| TRANS AT n-TH STD | $S'_1$ | $S'_2$ | $S'_3$ | --- | $S'_{n-1}$ | $S'_n$ |

FIG.1

| INIT. ROLL. STD. SCHED. | 1st STD | 2nd STD | 3rd STD | --- | (n-1)-TH STD | n-TH STD |
|---|---|---|---|---|---|---|
| BEFE ARR AT 1st STD | $V_1$ | $V_2$ | $V_3$ | --- | $V_{n-1}$ | $V_n$ |
| TRANS AT 1st STD | $a_1V_1$ | $a_1V_2$ | $a_1V_3$ | --- | $a_1V_{n-1}$ | $a_1V_n$ |
| TRANS AT 2nd STD | $a_2V_2 \frac{V_1'}{V_2'}$ | $a_2V_2$ | $a_2V_3$ | --- | $a_2V_{n-1}$ | $a_2V_n$ |
| TRANS AT 3rd STD | $a_3V_3 \frac{V_1'}{V_3'}$ | $a_3V_3 \frac{V_2'}{V_3'}$ | $a_3V_3$ | --- | $a_3V_{n-1}$ | $a_3V_n$ |
| ⋮ | ⋮ | ⋮ | ⋮ | ⋱ | ⋮ | ⋮ |
| TRANS AT (n 1)TH STD | $a_{n-1}V_{n-1} \frac{V_1'}{V_{n-1}'}$ | $a_{n-1}V_{n-1} \frac{V_2'}{V_{n-1}'}$ | $a_{n-1}V_{n-1} \frac{V_3'}{V_{n-1}'}$ | --- | $a_{n-1}V_{n-1}$ | $a_{n-1}V_n$ |
| TRANS AT n TH STD | $a_nV_n$ $(=V_1')$ $\frac{V_1'}{V_n}$ | $a_nV_n$ $(=V_2')$ $\frac{V_2'}{V_n'}$ | $a_nV_n$ $(=V_3')$ $\frac{V_3'}{V_n'}$ | --- | $a_nV_n$ $(=V_{n-1}')$ $\frac{V_{n-1}'}{V_n}$ | $a_nV_n$ $(=V_n')$ |

FIG. 2

METHOD OF CHANGING ROLLING SCHEDULE DURING ROLLING IN TANDEM ROLLING MILL

BACKGROUND OF THE INVENTION

This invention relates to improvements in a method of changing a rolling schedule while a work strip is passing through a tandem rolling mill without stopping the mill.

In conventional methods of changing the rolling schedule during the rolling of the work strip having a gauge change point in multi-stand tandem rolling mills, the screw-down position of the roll on the first roll stand has been updated when the gauge change point arrives at that roll and this process has been repeated with the succeeding roll stands while the well-known constant volume principle of material mass flow is fulfilled so that it has been attempted to prevent a change in tension of the work strip and others. In order to prevent a change in strip tension and others, Japanese patent publication No. 17145/73, for example, discloses that the ratio of rolling speed between adjacent roll stands is changed from its value according to the original schedule of operation to a new value at each roll stand at the same time point. However, the conventional roll speed control, as described above, has paid no attention to a decrease in an overall change in the roll speed which occurs in tandem rolling mills. Therefore, errors in the calculation of the rolling schedules, errors developed in an associated mill speed control system, etc., have caused, in actual operation, external disturbances which are, in turn, attended with transient disturbances occurring in the mass flow upon a change in the rolling schedule, such flow following the constant volume principle of material mass flow. Those transient disturbances can not be suppressed. For example, the interstand tension might be excessive and the roll force might be concentrated on a specified roll stand. This has resulted in the disadvantage that, in order to attain stable operation, the rolling schedule must be changed at a sacrifice in the rolling efficiency, that is, at reduced roll speeds.

Accordingly, it is an object of the present invention to provide a new and improved method of changing a rolling schedule during the rolling of a work strip in a tandem rolling mill without stopping the mill; such a method can minimize transient disturbances due to errors in the calculation of rolling schedules, errors in correction of the screw-down position and the roll speed, etc.

It is another object of the present invention to provide a method of changing a rolling schedule during the rolling of a work strip in a tandem rolling mill enabling an improved stability of operation and improved rolling efficiency, in addition to the minimization of the transient disturbances of the mass flow, as described above.

SUMMARY OF THE INVENTION

The present invention provides a method of changing a rolling schedule during the rolling of a work strip having a gauge change point in a tandem rolling mill including a plurality of roll stands without stopping the rolling mill, wherein roll speeds on the roll stands are changed when the gauge change point of the work strip arrives at any one of the plurality of roll stands, to form a roll speed pattern fulfilling the conditions for maintaining the steady-state mass flow constant and for minimizing the total sum of changes in roll speed on the plurality of roll stands on the basis of a function expressing a total amount of changes in roll speed.

Preferably, the conditions for maintaining the steady-state mass flow constant may be fulfilled so that, each time the gauge change point of the work strip arrives at any one of the roll stands, roll speeds on all the roll stands are uniformly changed so as to minimize a total amount of the changes in roll speed. Then, roll speeds on the roll stands including the roll stand at which the gauge change point arrives and disposed upstream of the last-mentioned roll stand are changed to speed ratios according to a new rolling schedule while roll speeds on the roll stands including the abovementioned any one of the roll stands which are disposed downstream thereof are kept to speed ratios according to the original rolling schedule.

Conveniently, the roll speed pattern may be formed by using the sum of the squares of ratios of change in the roll speed on the plurality of the roll stands as a minimizing estimation function.

BRIEF DESCRIPTION OF THE DRAWINGS

The present invention will become more readily apparent from the following detailed description taken in conjunction with the accompanying drawings in which:

FIG. 1 is a chart illustrating a pattern of changes in screw-down position as a gauge change point of the work strip passes through roll stands of a tandem rolling mill;

FIG. 2 is a chart similar to FIG. 1 but illustrating a pattern of changes in roll speed.

DESCRIPTION OF THE PREFERRED EMBODIMENT

Figure 3:
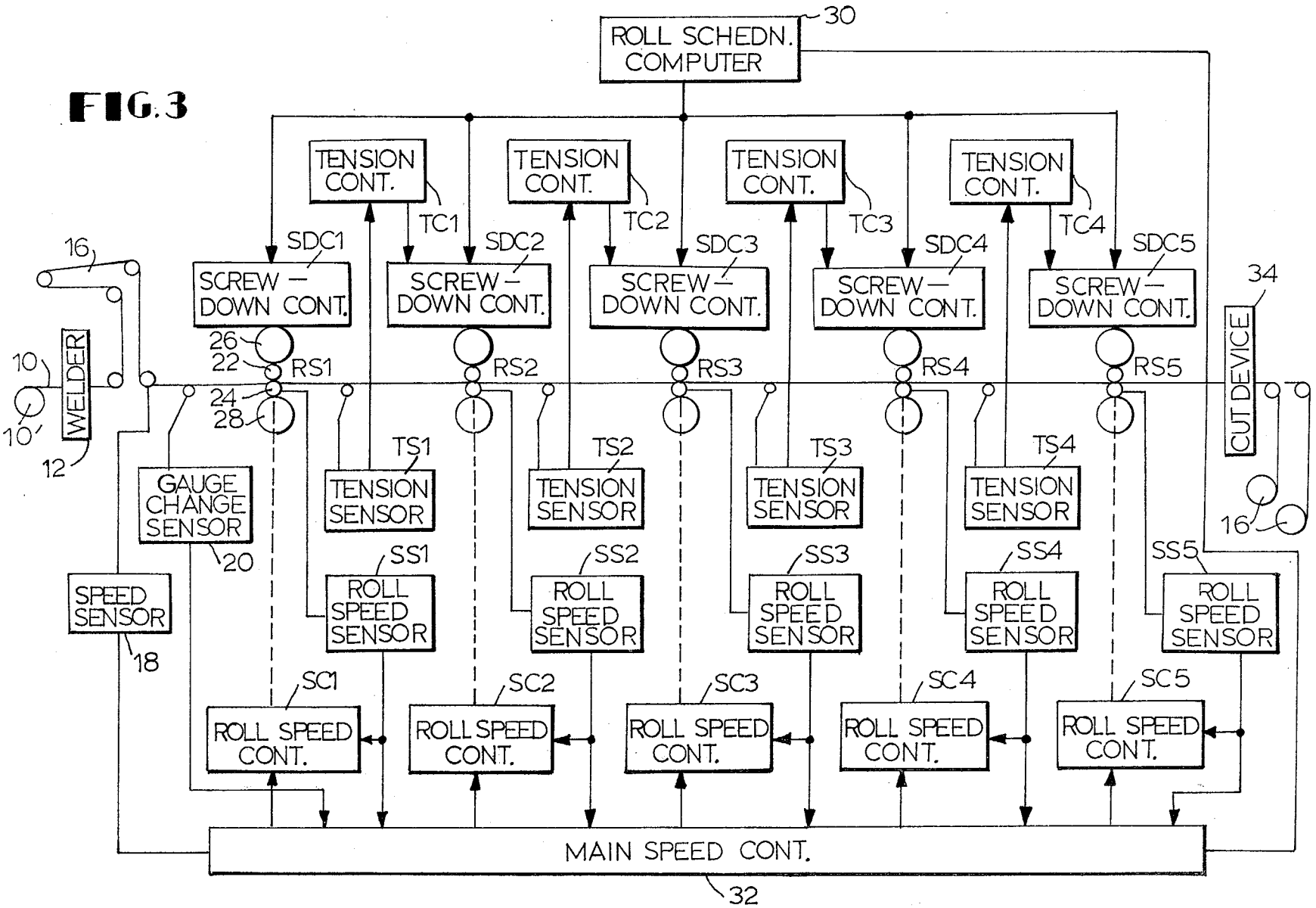
FIG. 3 is a schematic block diagram of a tandem rolling mill to which one embodiment of the present invention is applied.

In tandem rolling mills including the n roll stands, it is assumed the n roll stands have individual roll speeds $V_1, V_2, V_3, \ldots, V_n$ according to the original rolling schedule, and individual roll speeds $V_1', V_2', V_3', \ldots, V_n'$ according to a new rolling schedule before and after the change in the rolling schedule respectively. Also, the n roll stands have respectively established values of the screw-down position $S_1, S_2, S_3, \ldots, S_n$ according to the original rolling schedule and similar values $S_1', S_2', S_3', \ldots, S_n'$ according to the new rolling schedule before and after the change in the rolling schedule respectively.

Where a work strip having a gauge change point is passing through such a tandem rolling mill, the change in screw-down position is effected so that, when the gauge change point or transition arrives at the first roll stand, the screw-down position on that roll stand is changed from $S_1$ to $S_1'$ according to any of the well known systems, and when the gauge change point arrives at the second roll stand, the screw-down position on that roll stand is similarly changed from $S_2$ to $S_2'$, and so on. In general, when the gauge transition arrives at the i-th roll stand where $i=1, 2, 3, \ldots, n$, the screw-down position on that stand is changed from $S_i$ to $S_i'$ as will readily be understood from FIG. 1 wherein a pattern of changes in screw-down position is illustrated with respect to the n roll stands.

The roll speeds on the respective roll stands are changed following a pattern of changes in roll speed with respect to the n roll stands as shown in FIG. 2.

Simultaneously with the arrival of the gauge transition at any one of the roll stands, for example, the i-th roll stand, a speed ratio between the (i−1)-th and i-th roll stands is changed to a value of the roll speed according to a new rolling schedule. At the same time, all inter-stand speeds on those roll stands disposed upstream of the i-th roll stand are changed to values thereof according to the new rolling schedule while a speed ratio between the i-th and (i+1)-th roll stands and all inter-stand speed ratios on those roll stands disposed downstream of the (i+1)-th roll stand are maintained at values thereof according to the original rolling schedule. Therefore, it will readily be understood that the pattern of changes in roll speed fulfills the constant volume principle of material mass flow in the steady state before and after changes in steady-state roll speed and with coefficients $a_1, a_2, a_3, \ldots, a_n$ having arbitrary values. The term "steady state" prefixed to "roll speed" means any state other than that state in which a change in roll speed and a change in a screw-down are being effected and attended on a change in the rolling schedule. Each of the coefficients $a_i$ wherein (i=1, 2, 3, . . . , n) uniformly determines levels of the roll speeds on the respective roll stands after their change.

According to the present invention, the coefficient $a_i$ is selected to minimize the total amount of changes in roll stands on the roll stands effected when the gauge change point arrives at the i-th roll stand, (that is, with the gauge transition at the i-th roll stand). Such a coefficient $a_i$ may be determined in the manner as will be subsequently described by employing the sum of the squares of ratios of roll speed changes as a minimizing estimation function.

It is now assumed that the gauge change point is advanced from the (i−1)-th to the i-th roll stand to change a speed pattern from a speed pattern A expressed by $$\text{Speed Pattern } A_{i-1}=(a_{i-1}V_{i-1,1}, a_{i-1}V_{i-1,2}, \ldots, a_{i-1}V_{i-1,n}) \quad (1)$$

to a speed pattern expressed by $$\text{Speed Pattern } A_i=(a_iV_{i,1}', a_iV_{i,2}, \ldots, a_iV_{i,n}) \quad (2)$$

In the expressions (1) and (2) $a_{i-1}V_{i-1,j}$ where j=1,2, . . . , n designates the roll speed on the j-th roll stand upon the arrival of the gauge change point at the (i−1)-th roll stand and $a_iV_{i,j}$ satisfies the following expression:

$$V_{i,j} = V_i \frac{V_j'}{V_i'} \quad (\text{for } j < i)$$

$$= V_j \quad (\text{for } j \leqq i)$$

When the speed pattern is changed from $A_{i-1}$ to $A_i$, or when the gauge change point arrives at the i-th roll stand, the total amount of the resulting changes in ratio of roll speed may be defined by a minimizing estimation function $L_i$ which is defined by:

$$Li = C_1\left(\frac{a_{i-1}V_{i-1,1} - a_iV_{i,1}'}{a_{i-1}V_{i-1,1}}\right)^2 + \quad (3)$$

-continued $$C_2\left(\frac{a_{i-1}V_{i-1,2} - a_iV_{i,2}'}{a_{i-1}V_{i-1,2}}\right)^2 + \ldots +$$

$$C_n\left(\frac{a_{i-1}V_{i-1,n} - a_iV_{i,n}'}{a_{i-1}V_{i,n}}\right)^2$$

$$= \sum_{j=1}^{n} C_1\left(\frac{a_{i-1}V_{i-1,j} - a_iV_{i,j}'}{a_{i-1}V_{i-1,j}}\right)^2$$

where $C_1, C_2, \ldots, C_n$ designate weighting coefficients for the respective roll stands and are assumed normally to have values of unity. The abovementioned estimation function $L_i$ is one of the functions expressing a total amount of changes in roll speed on the n roll stands. More precisely the estimation function $L_i$ may be called an i-th speed change estimation function and is quadratic with respect to $a_i$.

The coefficient $a_i$ for minimizing the ratio of change in speed schedule is given by the following expression (4):

$$\frac{\partial L_i}{\partial a_i} = \sum_{j=1}^{n} C_j \cdot 2\left(\frac{a_{i-1}V_{i-1,j} - a_iV_{i,j}'}{a_{i-1}V_{i-1,j}}\right) \cdot \left(-\frac{V_{i,j}'}{a_{i-1}V_{i-1,j}}\right) = 0 \quad (4)$$

Solving equation (4) with respect to $a_i$ gives $$a_i = a_{i-1} \times \frac{\sum_{j=1}^{n} C_j\left(\frac{V_{i,j}'}{V_{i-1,j}}\right)}{\sum_{j=1}^{n} C_j\left(\frac{V_{i,j}'}{V_{i-1,j}}\right)^2}$$

By substituting the above-noted expression for $V_{i,j}$ and then substituting each roll speed shown in FIG. 2 into the expression (5), the $a_i$ is clearly determined by the following expressions (6) through (9):

$$a_1=1 \quad (6)$$

upon the arrival of the gauge transition at the first roll stand;

$$a_2 = a_1 \frac{C_1\left(\frac{V_2}{V_1}\cdot\frac{V_1'}{V_2'}\right) + (C_2 + \ldots + C_n)}{C_1\left(\frac{V_2}{V_1}\cdot\frac{V_1'}{V_2'}\right)^2 + (C_2 + \ldots + C_n)} \quad (7)$$

upon the arrival of the gauge transition at the second roll stand;

$$a_i = a_{i-1}\frac{(C_1 + C_2 + \ldots + C_{i-1})\left(\frac{V_i}{V_{i-1}} \cdot \frac{V'_{i-1}}{V_i}\right) + (C_i + \ldots + C_n)}{(C_1 + C_2 + \ldots + C_{i-1})\left(\frac{V_i}{V_{i-1}} \cdot \frac{V'_{i-1}}{V'_i}\right)^2 + (C_i + \ldots + C_n)} \quad (8)$$

upon the arrival of the gauge transition at the i-th roll stand; and $$a_n = a_{n-1}\frac{(C_1 + C_2 + \ldots + C_{n-1})\left(\frac{V_n}{V_{n-1}} \cdot \frac{V'_{n-1}}{V'_n}\right) + (C_i \ldots C_n)}{(C_1 + C_2 + \ldots + C_{n-1})\left(\frac{V_1}{V_{n-1}} \cdot \frac{V'_{n-1}}{V_n}\right)^2 + (C_i \ldots C_n)} \quad (9)$$

upon the arrival of the transition at the n-th or last roll stand.

It is to be noted that the roll speeds $V_1'$, $V_2'$, $V_3'$, . . . , $V_n'$ according to new rolling schedules are given only by ratios thereof and that the absolute values thereof are determined by the minimizing calculation as described above. This determination is possible because the absolute values of rolling schedules can be theoretically established at levels as desired in tandem rolling mills.

Practically, the coefficients $a_i$ can not be clearly determined by the conditions for maintaining the steady-state (which has the meaning as described above in conjunction with the "roll speed") mass flow constant as described above and it can be clearly determined by the "minimization of a total amount of changes in roll speed". Therefore, by substituting the value of the coefficient $a_i$ as determined above into the pattern of changes in roll speed shown in FIG. 2 and causing the roll speeds on the respective roll stands to follow the pattern of changes in roll speed shown in FIG. 2, the roll speeds on all the roll stands can be changed from associated values according to a pattern of roll speeds $$\left(a_{i-1}V_{i-1}\frac{V_1'}{V'_{i-1}}, a_{i-1}V_i\frac{V_2'}{V'_{i-1}} \ldots a_{i-1}V_n\right)$$

to those according to a pattern of roll speeds $$\left(a_iV_i\frac{V_1'}{V_i''}\ a_iV_i\frac{V_2'}{V_i'}, \ldots a_iV_n\right)$$

minimizing a total sum of changes in roll speed while the conditions for maintaining the steady-state mass flow constant are fulfilled. The changes in roll speed on the respective roll stands thereby be equalized as far as possible.

While the present invention has been described in terms of the sum of the squares of the ratios of the changes in the roll speed used as the minimizing estimation function for the total amount of changes in the roll speed it is to be understood that the same is equally applicable to the sum of the square of the changes or the sum of the absolute values of the changes in roll speed used as the minimizing estimation function.

Referring now to FIG. 3, there is illustrated a five-stand tandem rolling mill to which one embodiment of the present invention is applied. In the arrangement illustrated, a work strip 10 from a roll 10' passes through a welder 12 where it is welded to the preceding work strip which is different in gauge or thickness therefrom. The work strip 10, leaving the welder 12, has a gauge change point or a gauge transition and travels through a loop car 16 and then past an entry speed sensor 18 and a gauge change sensor 20 after which it enters a tandem rolling mill including five rolling stands RS1, RS2, RS3, RS4 and RS5. The entry speed sensor 18 senses the speed of the work strip 10 entering the rolling mill and the gauge change sensor 18 senses the gauge change point or transition of the work strip 10. Each of the roll stands RS1, RS2, RS3, RS4 or RS5 includes a pair of work rolls 22 and 24 between which the work strip 10 being rolled is passed, and a pair of backup rolls 26 and 28 operatively coupled to the work rolls 22 and 24. The work rolls of the roll stands are driven by respective drive motors (not shown), each drive motor controlled by a roll speed control SC1, SC2, SC3, SC4 or SC5. Each roll stand has a roll speed sensed by a roll speed sensor SS1, SS2, SS3, SS4 or SS5 and a screw-down position controlled by a screw-down control SDC1, SDC3, SDC4 or SDC5.

Tension sensors TS1, TS2, TS3 and TS4 are disposed along the run of the work strip 10 midway between the first and second roll stands RS1 and RS2, between the second and third roll stands RS2 and RS3, between the third and fourth roll stands RS3 and RS4 and between the fourth and fifth roll stands RS4 and RS5 respectively. The tension sensors TS1, TS2, TS3 and TS4 include respective outputs connected to tension controls TC1, TC2, TC3 and TC4 which are, in turn, connected to the screw-down position controls SDC2, SDC3, SDC4 and SDC5 respectively.

A rolling scheduling computer 30 is connected to the screw-down position controls SDC1, SDC2, SDC3, SDC4 and SDC5 and preliminarily calculates the original and new rolling schedules and stores them therein. The computer 30 is further connected to a main speed control computer 32 including inputs connected to the entry speed sensor 18, the gauge change sensor 20 and the roll speed sensors SS1, SS2, SS3, SS4 and SS5, and outputs connected to the roll speed controls SC1, SC2, SC3, SC4 and SC5 to which outputs of the speed sensors SS1, SS2, SS3, SS4 and SS5 are also connected.

In operation, the entry speed sensor 18 senses the the speed of the work strip 10 entering the first roll stand RS1 and supplies the sensed entry speed or actual speed thereof to the main control computer 32. Then, the gauge change sensor 20 senses the gauge change point of the work strip 10 being moved past the same. The computer 32 responds to the sensing of the gauge change point to be initiated to integrate the actual speed from the entry speed sensor 18. When the computer 32 integrates the actual speed to derive the distance between the gauge change sensor 20 and the first roll stand RS1 stored therein, the computer 32 determines when the gauge change point arrives at the first roll stand RS1. At that time, the computer 32 is initiated to integrate the roll speed or peripheral speed of the work roll 24 of the first roll stand RS1, sensed by the roll speed sensor SS1, and causes the rolling scheduling computer 30 to control the screw-down control SDC1 to change the screw-down position on that roll stand from the established value thereof $S_1$ to $S_1'$, as shown in FIG. 1. However, it is noted that, when the gauge change point arrives at the first roll stand RS1, the roll speeds on the roll stands RS1 through RS5 are maintained at their values ($V_1$, $V_2$, $V_3$, $V_4$, $V_5$) according to the original rolling schedules. This is because those values at that time are of $a_1V_1$, $a_1V_2$, $a_1V_3$, $a_1V_4$ and $a_1V_5$, as will ready be understood from FIG. 2, but $a_{1\text{-}1}$ has a value of unity, as described above. That is, those roll speeds remain unchanged.

The computer 32 integrates the sensed roll speed or peripheral speed of the work roll 24 on the first roll stand RS1 to derive the distance between the first and second roll stands RS1 and RS2 also stored therein so as to thereby determine the arrival of the gauge change point or transition at the second roll stand RS2. At that time, the screw-down control SDC2 similarly changes the screw-down position on that roll stand from its established value $S_2$ to $S_2'$ as shown in FIG. 1 while at the same time the main control computer 32 supplies, as command roll speeds, associated roll speeds as shown in FIG. 2 to the roll speed controls SC1, SC2, SC3, SC4 and SC5 to change the roll speed pattern ($a_1V_1$, $a_1V_2$, $a_1V_3$, $a_1V_4$, $a_1V_5$) where $a_1=1$ to a new roll speed pattern ($a_2V_2V_i/V_i$, $a_2V_2$, $a_3V_3$, $a_2V_4$, $a_2V_5$) as will ready be understood from FIG. 2.

This change in roll speed pattern causes a variation in tension of that portion of the work strip 10 being moved between the first and second roll stands RS1 and RS2. The tension sensor TS1 senses this variation in tension and supplies its output to the tension control TC1. Therefore, the tension control TC1 is actuated to finely adjust the screw-down position on the second roll stand RS2 through the screw-down control SDC2 with the result that the tension of the work strip 10 is maintained at a predetermined constant magnitude between the first and second roll stands RS1 and RS2 respectively.

The process as described above is repeated with the succeeding roll stands RS3, RS4 and RS5. More specifically, the successive arrival at the roll stands RS3, RS4 and RS5 is determined by the main control computer 32 by successively integrating sensed roll speeds from the roll speed sensor SS3, SS4 and SS5 to be equal to associated interstand distances respectively. Each time the gauge change point arrives at the roll stand RS3, RS4 or RS5 as determined by the computer 32, the screw-down control SDC3, SDC4 or SDC5 responds to a command screw-down from the rolling scheduling computer 30 to change the screw-down position on the roll stand RS3, RS4 or RS5 from its value $S_3$ to $S_3'$, $S_4$ to $S_4'$ or $S_5$ to $S_5'$ respectively. Simultaneously, the computer 30 supplies as command roll speeds, the roll speeds such as shown, for example, in the fourth row of the chart illustrated in FIG. 2. This causes the roll speed pattern for the five roll stands from ($a_2V_2V_1'/V_2'$, $a_2V_2$, $a_2V_3$, $a_2V_4$, $a_2V_5$) to ($a_3V_3V_1'/V_3'$, $a_3V_3V_2'/V_3'$, $a_3V_3$, $a_3V_4$, $a_3V_5$) subsequently changed to ($a_4V_4V_1'/V_4'$, $a_4V_4V_2'/V_4'$, $a_4V_4V_3'/V_4'$, $a_4V_4$, $a_4V_5$) which is, in turn, changed to ($a_5V_5V_1'/V_5'$, $a_5V_5V_2'/V_5'$, $a_5V_5V_3'/V_5$, $a_5V_5V_4'$, $a_5V_5$). Also, the interstand strip tension is maintained constant by the tension sensors TS2, TS3 or TS4 and the tension control TC2, TC3, or TC4.

A shearing device 34 cuts the finished work strip issued by the last or fifth roll stand RS5 to predetermined lengths and the cut strips are coiled into rolls 16.

While the present invention has been illustrated and described in conjunction with a single preferred embodiment it is to be understood that numerous changes and modifications may be resorted to without departing from the spirit and scope of the present invention.

What I claim is:

1. A method of changing a rolling schedule on the passage of a work strip having a gauge change point through a tandem rolling mill including a plurality of roll stands without stopping the rolling mill comprising changing roll speeds on all of the plurality of roll stands when the gauge change point of the work strip arrives at one of the plurality of roll stands, wherein a roll speed pattern is arranged for maintaining the steady-state mass flow constant and for minimizing a sum of changes in roll speed on the basis of a function expressing a total amount of the changes in roll speeds on the plurality of roll stands; and wherein the roll speed pattern is arranged for maintaining the steady-state mass flow constant so that, each time the gauge change point arrives at one of the plurality of roll stands, the roll speeds on all of the plurality of roll stands are uniformly changed so as to minimize a total amount of the changes in roll speeds and then, the roll speeds on the roll stand at which the gauge change point arrives and the roll stands disposed upstream of the roll stand at which the gauge change point arrives are changed to speed ratios according to a new rolling schedule while the roll speed on the roll stand at which the gauge change point arrives and the roll stands disposed down-stream thereof are held at speed ratios according to the just preceding rolling schedule.

2. A method of changing a rolling schedule as claimed in claim 1, wherein the roll speed pattern is determined by using the sum of the squares of ratios of changes in the roll speeds on the roll stands as a minimizing estimation function.

3. A method of changing a rolling schedule as claimed in claim 1, wherein the roll speed pattern is determined by using the sum of the absolute values of ratios of changes in the roll speeds on the roll stands as a minimizing estimation function.

* * * * *